US006692092B1

(12) United States Patent
Evans

(10) Patent No.: US 6,692,092 B1
(45) Date of Patent: Feb. 17, 2004

(54) TRANSPORTABLE PLAY CENTER

(76) Inventor: Gail W. Evans, 9717 Old Dell Trace, Richmond, VA (US) 23233

( * ) Notice: Subject to any disclaimer, the term of this patent is extended or adjusted under 35 U.S.C. 154(b) by 0 days.

(21) Appl. No.: 09/688,592

(22) Filed: Oct. 16, 2000

(51) Int. Cl.[7] ..... A47B 83/00

(52) U.S. Cl. ..... 312/311; 312/262; 312/249.9; 446/482

(58) Field of Search ..... 312/200, 262, 312/258, 241, 235.3, 270.2, 311, 313, 321.5, 249.9; 52/36.4, 36.5, 239; 108/38, 41, 94, 97; 446/482, 487, 478

(56) References Cited

U.S. PATENT DOCUMENTS

| | | | | | |
|---|---|---|---|---|---|
| 1,655,884 | A | | 1/1928 | Wood | |
| 1,777,542 | A | | 10/1930 | Baerman | |
| 2,566,256 | A | | 8/1951 | Snyder | |
| 2,582,575 | A | | 1/1952 | Young | |
| 2,755,156 | A | | 7/1956 | Nichols | |
| 3,087,767 | A | | 4/1963 | Schell | |
| 3,126,236 | A | | 3/1964 | Buchan et al. | |
| 3,282,634 | A | * | 11/1966 | Marcus | 312/311 |
| 4,344,660 | A | * | 8/1982 | Molnar et al. | 312/249.13 |
| 4,361,368 | A | * | 11/1982 | Daniels | 312/321.5 |
| 4,375,306 | A | * | 3/1983 | Linder | 312/250 |
| 4,478,467 | A | | 10/1984 | Tyndall | |
| 4,480,744 | A | * | 11/1984 | Blackmon | 312/245 X |
| 4,669,789 | A | | 6/1987 | Pemberton | |
| 4,696,652 | A | * | 9/1987 | Reeder et al. | 446/478 X |
| 5,429,432 | A | | 7/1995 | Johnson | |
| 5,435,769 | A | * | 7/1995 | Bertrand | 446/482 X |
| 5,536,080 | A | * | 7/1996 | Madimenos et al. | 312/249.9 X |
| 5,558,418 | A | * | 9/1996 | Lambright et al. | 312/321.5 |
| 5,584,548 | A | * | 12/1996 | Miller | 312/235.3 |
| 6,048,044 | A | * | 4/2000 | Biggel et al. | 312/258 |
| 6,293,328 | B1 | * | 9/2001 | Fremont | 52/36.4 X |

* cited by examiner

*Primary Examiner*—Winnie S. Yip
(74) *Attorney, Agent, or Firm*—Hunton & Williams

(57) ABSTRACT

A transportable play center that has a center housing and two side housings attached to opposite sides of the center housing is provided. The play center is configured to provide a child with multiple play opportunities. The play center can be configured with a plurality of shelves that have transparent sliding doors. Further, the play center may be configured with a plurality of removable pockets. Still further, the play center may be equipped with removable carts that have a plurality of drawers in the carts. A tabletop may be slidably received in the center housing and a collapsable chair stored in the play center.

8 Claims, 7 Drawing Sheets

TRANSPORTABLE PLAY CENTER

BACKGROUND OF THE INVENTION

In today's mobile society it is often necessary for families to transport young children to settings where play items are not available. Parents of young children who have had the experience of waiting for a doctor or dental appointment, or for a seat in a restaurant or airport can understand the difficulty in attempting to distract and entertain a child until the wait is finished. In addition, there are times when travelling with a young child on vacation or for work purposes is necessary.

When unable to entertain themselves through play, young children can become intractable, unhappy and, ultimately, disruptive. It is embarrassing and frustrating when the child becomes irritable and disruptive. Further, there may not be an opportunity to leave the environment with the child. Sometimes a laundry basket of toys is on hand. Unfortunately, many of such toys have long outlived their purpose and require adults to find missing or mismatched pieces, which, if present at all, are always on the bottom of the basket.

Consequently, there is a need for a child friendly transportable play center that creates a learning and entertaining environment for young children, and allows for the securing and storage of an ample variety of play items.

SUMMARY OF THE INVENTION

The present invention is directed to a portable play center having a center housing that defines a center cavity and a pair of side housings that are hingedly attached to opposite sides of the center housing. The pair of side housings each define a side cavity and are rotatable between an open position providing access to the center cavity and each of the side cavities and a closed position preventing access to the center cavity.

The transportable play center of the present invention may further include a child interest device. The child interest device may include at least one pouch or mesh pocket releasable attached to one of the side housings. The child interest device may also include at least one Velcro® tab or snap device mounted on one of the side housings. The child interest device may also include at least one shelf in the center housing having a transparent sliding door providing access to the shelf Further, the child interest device comprises at least one shelf, in one of the side housings, having a transparent sliding door providing access to the shelf. The child interest device may also include a removable drawer unit contained in the center storage cavity. The transportable play center may further include a tabletop slidably received in the center housing.

The transportable play center of the present invention may also include side housings that each have a side housing depth and a side housing width and the center housing has a center housing depth and center housing width and wherein the side housing depth is about two-thirds the center housing depth and the combined side housing width is about the same as the center housing width.

The transportable play center may also have a pair of wheels located on the center housing, adjacent to the floor for transporting the play center and may also have a handle attached to the center housing. Still further, the transportable play center may be constructed of plastic, or like materials.

The present invention is also directed to a transportable play center that has a center housing defining a center cavity.

The transportable play center also has a pair of side housings hingedly attached to opposite sides of the center housing. The pair of side housings each define a side cavity and are rotatable between an open position providing access to the center cavity and each of the side cavities and a closed position preventing access to the center cavity. The transportable play center may also include a tabletop slidably received in the center housing. The transportable play center also includes at least one shelf that has a transparent sliding door that is located in the center housing above the tabletop. The transportable play center also contains at least one drawer unit removably received in the center housing below the tabletop.

The tabletop may further contain at least one leg adapted to be folded under the tabletop when the tabletop is stored in the center housing. The tabletop may also be equipped with flat rail attachments capable of mounting a building set base. The tabletop may also include a snap-on base capable of holding drawing related devices.

The transportable play center may have at least one pouch releasable attached to one of the side housings, Further, the transportable play center may have at least one shelf in one of the side housings and having a transparent sliding door providing access to the shelf.

Further, the transportable play center may contain a pair of wheels located on the center housing, adjacent to the floor for transporting the play center, which may have a securing means to act as stoppers for the wheels, locking them in place. The transportable play center may also have at least one handle, for assisting in transporting the center, on the center housing. The transportable play center may be constructed of plastic, or like materials.

The transportable play center may also include a net pouch removably attached to the inside of one of the side housings. The net pouch may be constructed of mesh, and may be either small or large, capable of storing large or small toys or other items of various shapes and sizes.

Still further, the transportable play center may include side housings that each have a side housing depth and a side housing width and may include the center housing that has a center housing depth and center housing width. The side housing depth is about two-thirds the center housing depth and the combined side housing width is about the same as the center housing width.

DETAILED DESCRIPTION OF THE INVENTION

Figure 1:
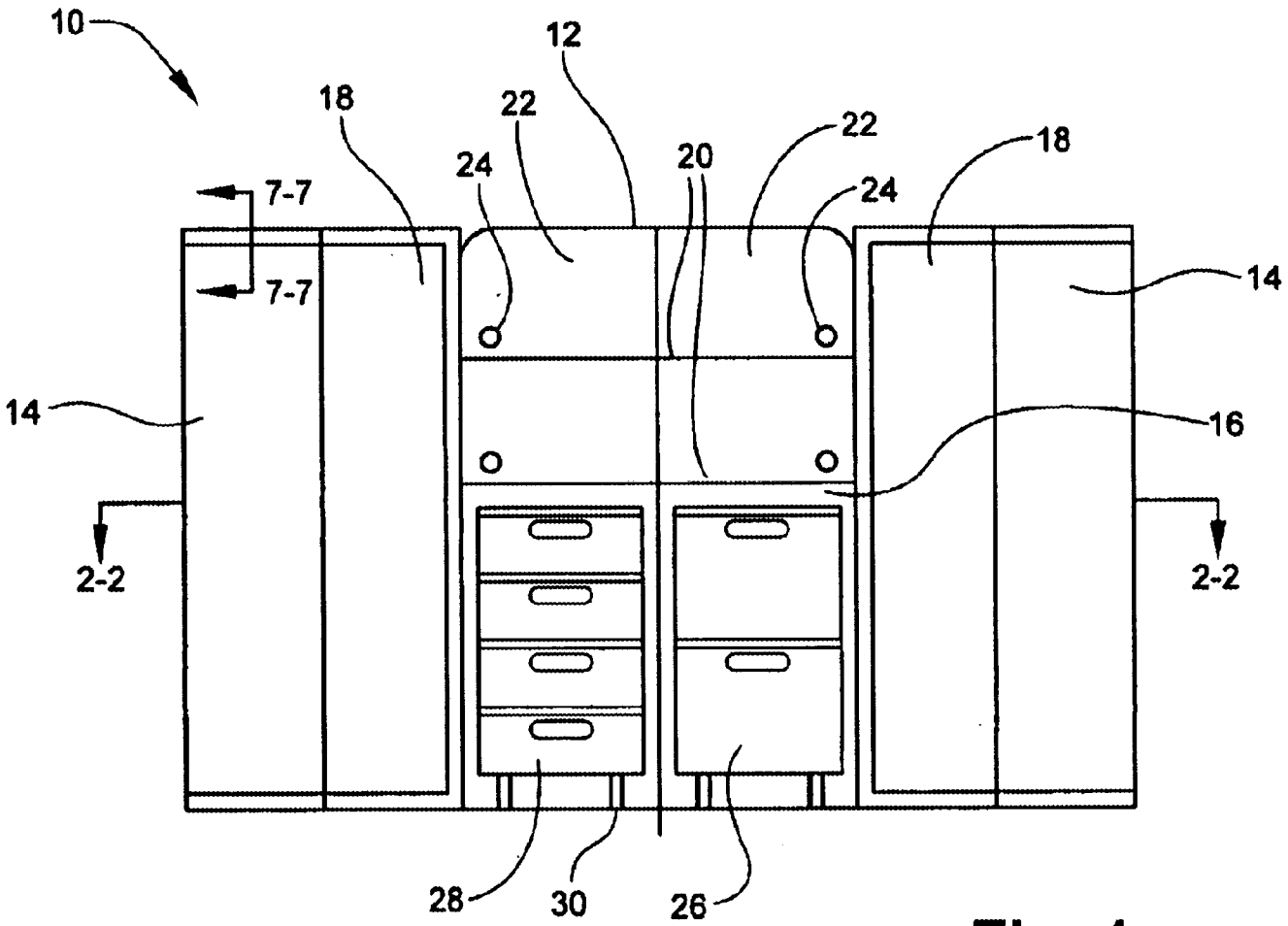
FIG. 1 is a front view of a play center in accordance with the present invention in the open position.

The present invention generally relates to a transportable play center. More specifically, the invention relates to a play center that contains a variety of child interest devices that are designed to encourage play and learning by young children and that can be used to store toys and other items when not in use. The child interest devices are capable of being removed from the play center to provide alternative play options. The play center is easily transportable allowing for portable movement of the play center or use as a furniture accessory piece when not in use.

An object of the present invention is to provide a play opportunity that is learning centered with a variety of creative opportunities that attract and encourage young children. The play center of the present invention provides young children with learning based play opportunities that can entertain, educate and provide for a positive, less disruptive experience for the child, parent and by-standers. The play center is designed to encourage play and allow for play items to be transported elsewhere within the environment to provide young children with varied opportunities to entertain themselves. Whenever a young child can be taught self control by means of positive as opposed to negative reinforcement, the child has learned constructive alternatives for appropriate behavior.

The present invention can be adapted for use in a variety of circumstances. Some settings where the present invention could be utilized include offices, grocery stores, department stores, restaurants, childcare or daycare facilities, car dealerships, hotels and motels and airport, train and bus terminals. The play center may also be used for families traveling on vacation or for extended periods or at a grandparent's or relative's home where play materials for a young child might not be readily available.

As will be discussed in detail below, the present invention provides various child interest devices that are meant to increase a child's curiosity and entice them to investigate, thus providing the child with a play opportunity that is creative and educational. For example, one embodiment of the present invention includes removable mesh pockets. Pockets are of great interest to young children as they provide them with the opportunity to imitate the motion of taking out and putting in. This activity helps to develop the child's eye-hand coordination skills and cognitive recognition skills. In addition, the pockets have removable tabs that allow them to be pulled off and pushed on. A toddler can be entertained for an extended period just by pulling the pocket off the wall of the unit, walking away, putting something in it, walking back and putting it back up on the wall. Almost all of the child interest devices in the present invention are capable of being removed and taken elsewhere. Preschoolers experience a sense of power and control when they can pull something out, as in the case of rolling storage carts, and move it by themselves. Children also love to look inside drawers as well as remove them, fueling their curiosity and sense of power and control. Further, the portability of the storage pieces allows for items to be taken to another room or provide for shared play with another child.

The present invention provides a lightweight, plastic structure that is stable, durable and easy for a child to open, close or manipulate. In addition, transporting the play center is simplified by use of permanently mounted caster wheels on the bottom backside of the unit which allow it to be tilted and rolled with little effort. The caster wheels may also include a means for securing the wheels, thus preventing movement of the play center when engaged. Thus, the play center is safe, easy for a young child to use, secure and easily transportable.

Figure 2:
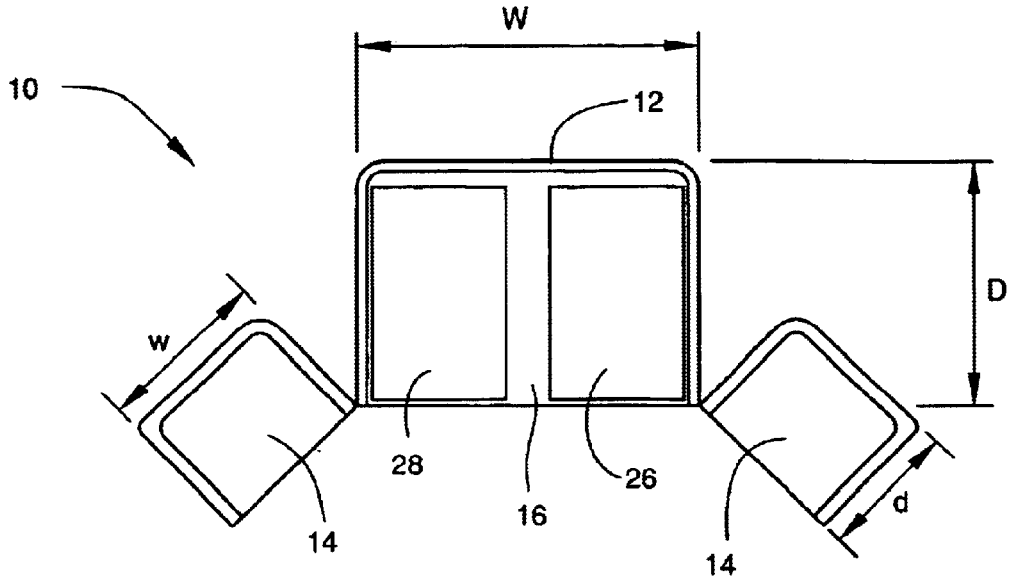
FIG. 2 is a sectional view of the play center shown in FIG. 1 taken at 2—2.

With reference now to FIGS. 1 and 2, there is shown one embodiment of the play center 10 in accordance with the present invention. Generally, the play center 10 has three main sections. The se sections include a center housing 12, and a pair of side housings 14. The two side housings 14 are attached to opposite sides of the center housing 12. Preferably the side housings 14 are attached by hinges. A set of hinges 60 allow the side housings 14 to rotate between an open position, and a closed position. FIGS. 1 and 2 illustrate the play center 10 in the open position while FIG. 3 best illustrates the play center 10 in a closed position.

The present invention is configured to provide a stable structure that can be opened, closed, and used by a young child while minimizing the risk of injury. In a preferred embodiment, the dimensions for the center housing 12 provide for about an 18-inch depth (D) and about a 24-inch width (W). With these dimensions for the center housing 12, the two side housings 14 should have about a 12-inch depth (d) and a 12-inch width (w) and have a height (h) of about the same height (H) as the center housing, 12. The exact dimensions of the center housing 12 and the side housings 14 are not crucial; however, the dimensions should be sufficient to impart stability to the play center in both the open and closed configurations.

The depth (d) of the side housing 14 should be approximately ⅔ the depth (D) of the center housing 12. This ratio helps impart stability to the play center 10 minimizing the risk of injury to a child when the side housings 14 are open. The width (w) of the side housings 14 should be wide enough to cover the width (W) of the center housing 12 when the play center 10 is in the closed position. The widths (W) of the two side housings 14 do not have to be equal as long as their combined width is wide enough to cover the center housing 12. The height (h) of the two side housings 14 should be approximately the same the height (H) of the center housing 12.

Preferably, the play center 10 is constructed of a lightweight, yet sturdy material, such as plastic. A preferred plastic is the type of injection molded plastic often used in play articles that receive heavy-duty interaction by children, such as that used in outdoor play equipment. The walls of the play center 10 may be constructed of lightweight, injection molded plastic, with a thin inner layer 34 and an outer layer 32 and a hollow or foam filled inner core 33. Furthermore, the walls of the play center may be solid.

The center housing 12 and the two side housings 14 each define a center cavity 16 and side cavities 18, respectively. A variety of child interest devices, designed specifically to attract children and to encourage learning and play, are configured in the cavities of the housings. The specific child interest devices are designed based on a child's cognitive development with specific emphasis on actions children imitate in order to learn. As used herein, "child interest devices" are those devices or activities that attract a child and encourage the child to investigate, play and solve problems. Such devices may include, but are not limited to, removable pockets, removable large or small pouches, Velcro® tabs and other snap devices for holding items, shelves with transparent sliding doors, removable drawer units, and a slidably receivable table.

As shown in FIG. 1, one embodiment of the present invention has at least one shelf 20 in the upper portion of the center housing 12. Transparent sliding doors 22 are associated with the front of the shelf and preferably have a finger hole 24 for sliding the door open and closed. This type of shelf is useful in developing a child's problem solving skills. The child sees what items are on the shelf 20 and must figure out how to gain access to the shelf 20. The transparent sliding doors 22 not only act to secure toys or other items on the shelf 20 during transportation but also act to entice children. The children can see what toys are located on the shelf 20 and operate the sliding door 22 to gain access to the desired items. Placing fingers in the hole 24 and sliding the door 22 to gain access to the shelf 20 exercises a child's motor skills.

The center housing may contain a pair of removable drawer carts 26 and 28 located below the shelf The drawer carts 26 and 28 move by means of wheels 30 mounted on the bottom of each cart. The carts can be configured to have four drawers or two drawers. These carts are both removable from the center housing 12. Each drawer is configured such that a child my easily open and close the drawers. The face of the drawers may be made of transparent material.

Figure 4:
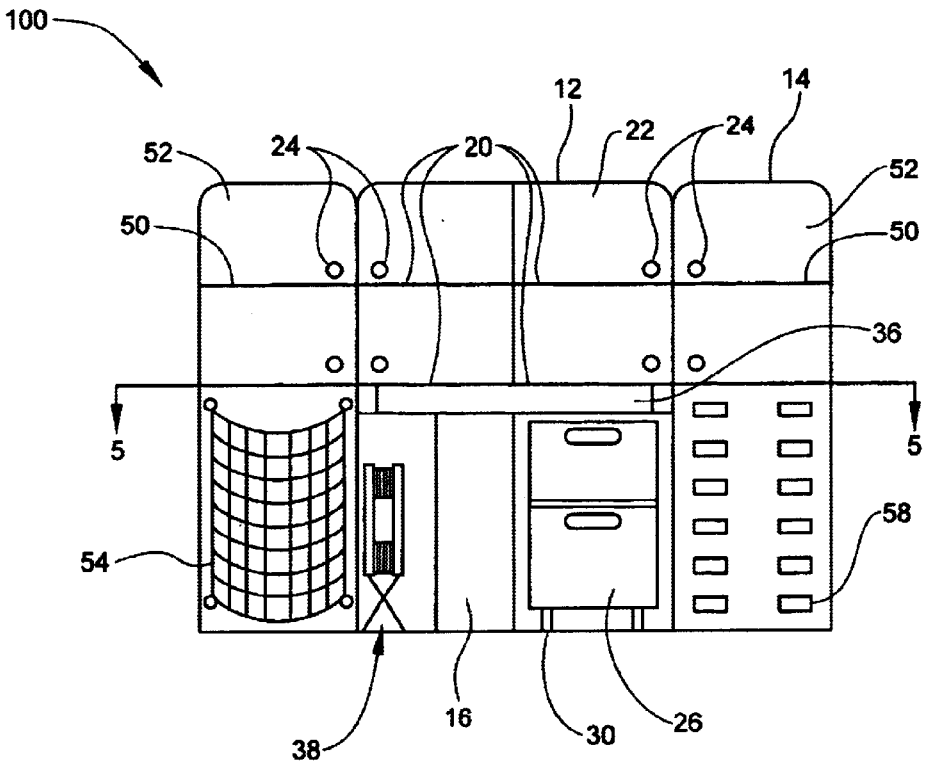
FIG. 4 is a front view of another embodiment of the present invention.
Figure 5:
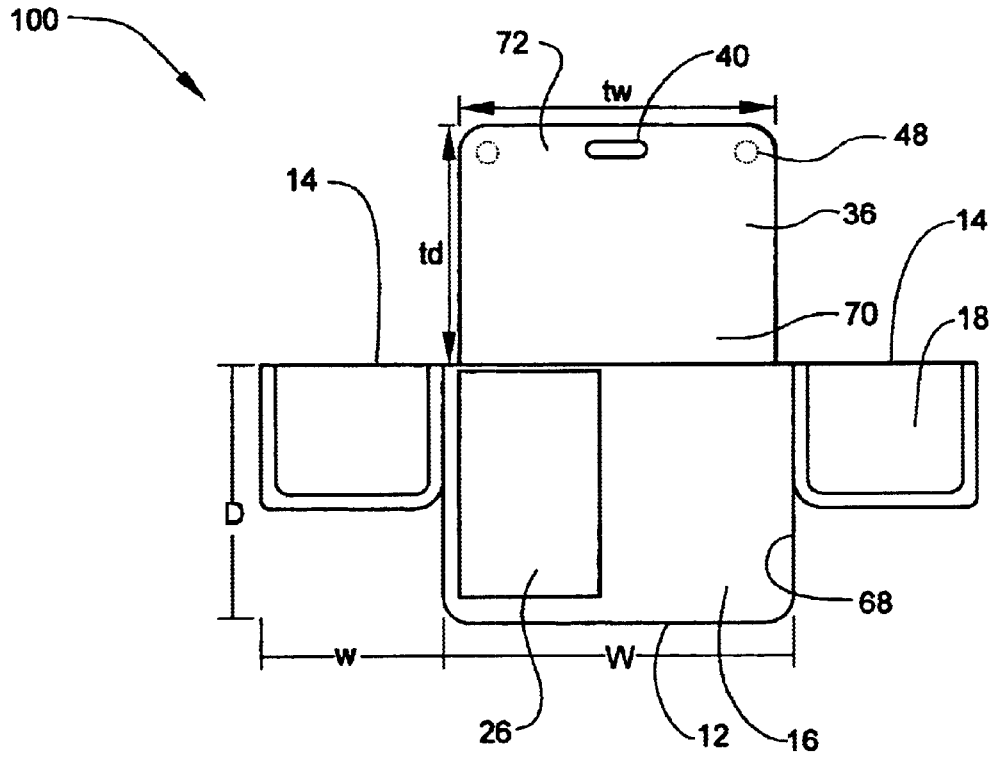
FIG. 5 is a top view of the play center shown in FIG. 4.
Figure 6:
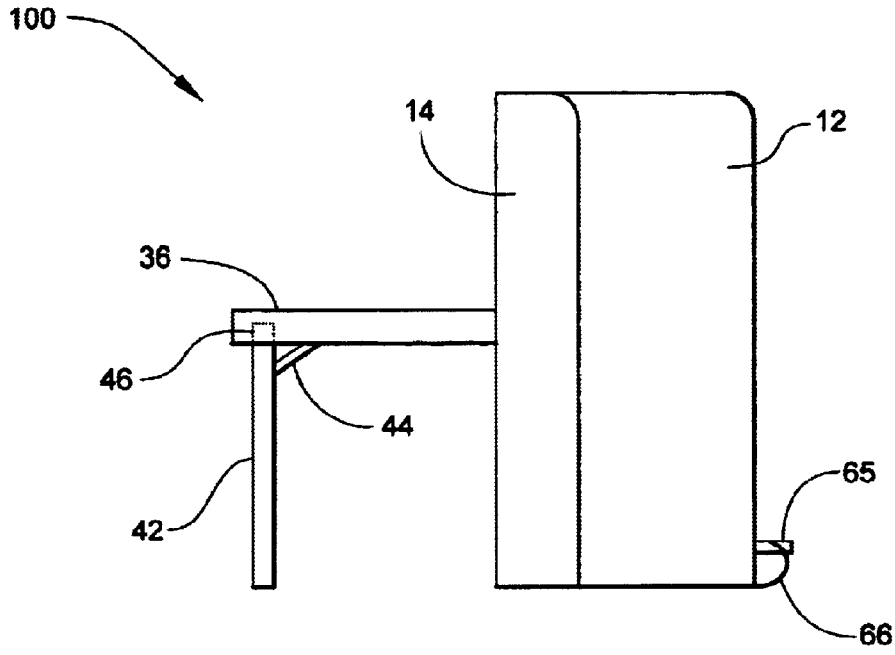
FIG. 6 is a side view of the play center shown in FIG. 4.
Figure 7:
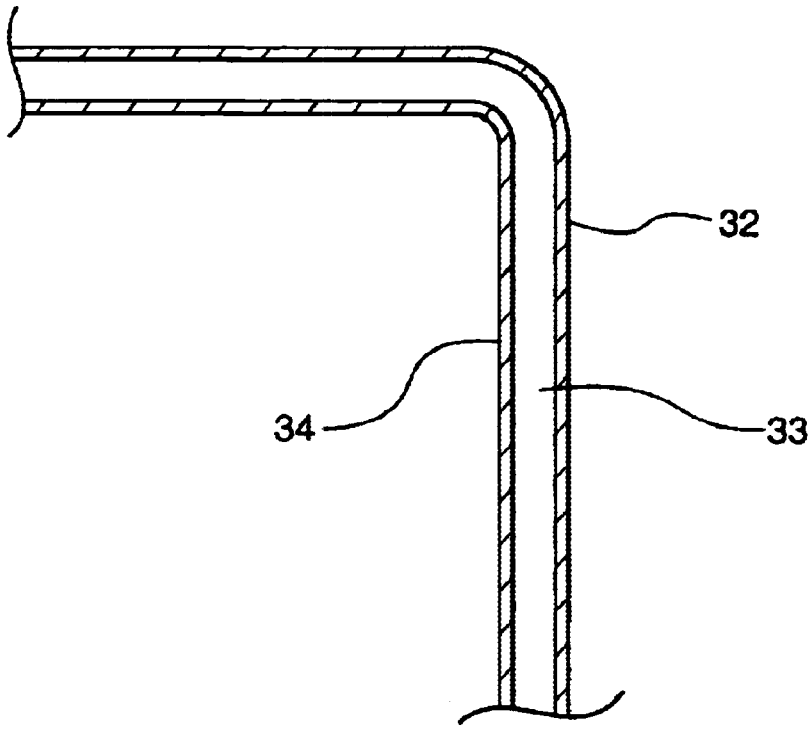
FIG. 7 is a sectional view of the play center shown in FIG. 1 taken at 7—7.

With reference now to FIGS. 4, 5, and 6, there is shown another embodiment 100 of the present invention. In this embodiment, the center housing 12 is configured with at least one shelf 20 having transparent sliding doors 22 as described above. Below the shelf 20 there is a stable, easy to manipulate, tabletop 36 slidably received in the center cavity 16 and one collapsible director or crossed leg chair 38. The tabletop 36 is preferably made of injection molded plastic. The depth (td) and width (tw) of the tabletop 36 are preferably about the same as the depth (D) of the center housing 12. Thus, when the depth (D) of the center housing 12 is about 18 inches, the depth (td) of the tabletop 36 is preferably about 18.

The tabletop 36 can be pulled out via two plastic runners 38 positioned on either side of the inside walls 68 of the center housing 12 and by means of an integrated plastic handle 40 situated on the middle front of the tabletop 36 allowing a young child to easily pull the tabletop out. Two legs 42 are hingedly attached to the underside of the tabletop 36. The two legs 42 are constructed of plastic and fold via a hinge 44 on each leg toward the back 70 of the tabletop 36 when in closed position. To set up the tabletop 36, the legs 42 are preferably pulled forward and secured in place. Each leg 42 may have a tab 46 that fits and locks into a depressed notch 48 on the underside of the front portion of the tabletop 36.

The tabletop 36 is configured so that it may easily be pulled out and secured by a young child. The child is able to pull out the tabletop 36 gradually and secure it by folding down the two legs 42 on either side. The tabletop 36 is supported by two legs 42 that can be easily moved toward the child, the legs 42 provide stable support for the tabletop 36 on the front edge 72, the section of the tabletop 36 most likely to be used by the child, thus reducing the potential for injury to the child. Support in this location is preferred for young children who might attempt to lean or sit upon the tabletop.

The tabletop 36 may be equipped with flat rail attachments or a snap-on base 76.

A removable drawer cart 26, as described earlier, may be placed under the tabletop 36 on one side of the center cavity 16. The other side of the center cavity 16 may be used for storing a chair 38 or a second drawer unit 28. Any chair 38 that is safe for children and easy for children to manipulate may be used with the present invention, including a director or crossed leg style chair. This type of chair folds easily for storage in the center cavity 16 under the tabletop 36.

As shown in FIG. 4, each of the side housings 14 may be configured with at least one shelf 50 having transparent sliding doors 52. Further, the side housings 14 may be configured with a net pocket 54. The side housings 14 may also be configured with a plurality of removable pockets 56. The pockets 56 may be mesh pockets and may utilize snaps, Velcro® tabs, or other similar mechanisms for removably attaching the pockets 56 to the inside of the side housing 14. The large, mesh storage pocket 54 may be mounted using removable tabs or snaps attached to the back wall 74 of one of the side housing 14. One or more rows of removable pockets 56 may be attached to the back wall 74 of the other side housing 14. Further, rows of removable tabs 58 may also be used to hold dress up clothes or small stuffed animals, such as beanie style or other lightweight toys.

The child interest devices are designed specifically to attract and encourage play by young children. The mesh pockets, Velcro® tabs, snaps, transparent doors, shelves and drawers provide the opportunity for children to see what is there while maintaining play articles in a secure position, thus attracting the child's interest to the play materials. Furthermore, specific storage options are designed based upon a child's cognitive development with specific emphasis on actions children imitate in order to learn. Specifically, young children enjoy the learning action of taking items out of locations and putting them back in. Pockets are of particular interest and intrigue for children. The use of pockets as a storage option not only encourages play, it can aid young children in the development of important cognitive recognition skills related to spatial displacement as well as small motor manipulation skills.

The present invention provides child interest devices that can be removed from the play center and used elsewhere. The feature allows for more play options such as, play in another area from where the play center is located. Clean up is facilitated because the removable devices can be carried to the different areas where play materials are dispersed, rather than having to carry everything back and forth to the unit or attempting to juggle several articles while returning them to the storage area.

Figure 3:
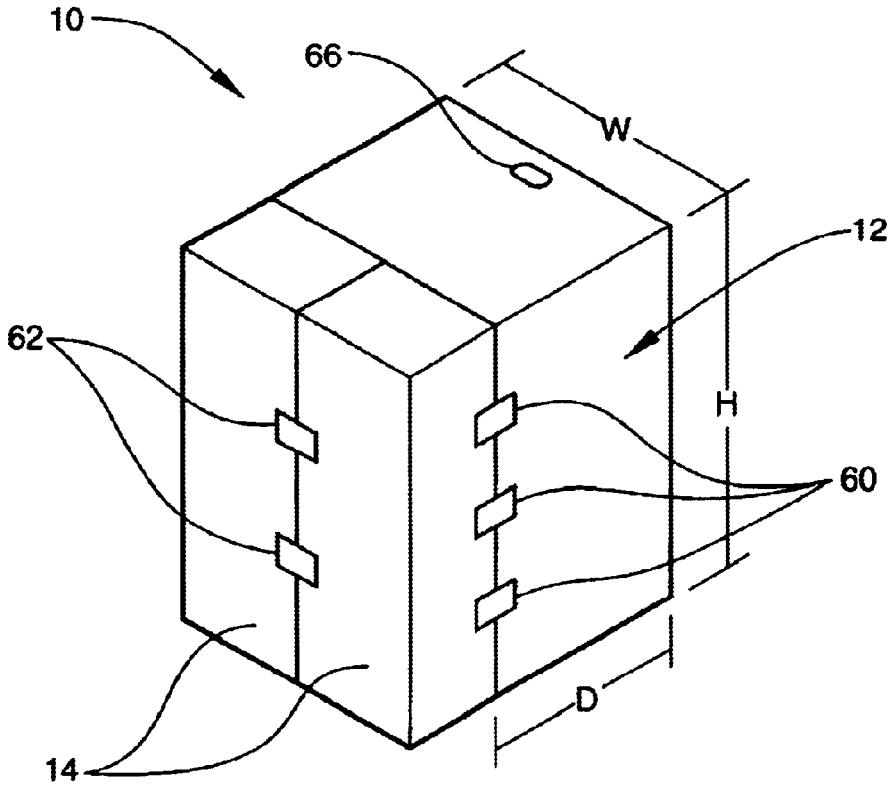
FIG. 3 is a perspective view of the play center shown in FIG. 1 in the closed position.

Referring to FIG. 3, the play center 10 is opened and closed by rotating the side housing 14 about a set of hinges 60 on the outside walls of the two side housings 14. At least one latch 62 is located on the front of the play center 10 and is used to connect the two side housings 14 together and secure them in place.

As best illustrated in FIG. 6, the play center 10 or 100 preferably contains a pair of wheels 64 located on the back of the center housing 12. Shown in FIG. 3, the play center 10 or 100 preferably contains a built-in, molded handle 66 located on the top back wall of the center housing 12. The play center 10 or 100 can be transported by using the handle 66 to tilt the play center such that the wheels 64 of the play center are able to roll along the floor. The handle 66 may also include a pull-out handle. The wheels 64 of the play center may also have a securing means 65 for releasable stopping the center when it is in use.

When in the closed position, play materials are held in secure compartments of the child interest devices, such as, shelving, sliding doors, mesh storage pockets, rolling storage carts with drawers, or by means of Velcro® tabs or other snap devices. While closed, the play center may be stored out of sight in a closet or vehicle. Alternatively, the closed play center may be used as a freestanding accessory piece of furniture resembling an office file cabinet or play center.

Those persons skilled in the art will readily understand that the present invention is susceptible to broad utility and application. Many embodiments and adaptations of the present invention other than those herein described, as well as many variations, modifications and equivalent arrangement, will be apparent from or reasonably suggested by the present invention and the foregoing description without departing from the substance or scope of the present invention.

Accordingly, while the present invention has been described in detail in relation to its preferred embodiment, it is to be understood that this disclosure is only illustrative and exemplary of the present invention and is made merely for purposes of providing a full and enabling disclosure of the invention. The foregoing disclosure is not intended to be construed to limit the present invention or otherwise exclude any other embodiments, adaptations, variations, modifications or equivalent arrangements, the present invention being limited only by the claims and the equivalents thereof.

What is claimed is:

1. A portable play center comprising:

a center housing defining a center cavity;

a pair of side housings hingedly attached to opposite sides of the center housing, wherein the pair of side housings each define a side cavity and are rotatable between an open position providing access to the center cavity and each of the side cavities and a closed position preventing access to the center cavity, and wherein the side housings each have a side housing depth and a side housing width and the center housing has a center housing, depth and center housing width and wherein the side housing depth is about two-thirds the center housing depth and the combined side housing width is about the same as the center housing width;

a pair of wheels attached to the center housing;

a handle attached to the center housing; and at least one child interest device for storing articles within during transport of the portable play center, wherein the child interest device comprises a removable drawer unit contained in the center cavity, the portable play center configured for rolling transport by tilting the play center on the wheels and pulling the handle by a child.

2. A portable play center comprising:

a center housing defining a center cavity;

a pair of side housings hingedly attached to opposite sides of the center housing, wherein the pair of side housings each define a side cavity and are rotatable between an open position providing access to the center cavity and each of the side cavities and a closed position preventing access to the center cavity, and wherein the side housings each have a side housing depth and a side housing width and the center housing has a center housing depth and center housing width and wherein the side housing depth is about two-thirds the center housing depth and the combined side housing width is about the same as the center housing width;

a pair of wheels attached to the center housing;

a tabletop slidably received in the center housing;

a handle attached to the center housing; and at least one child interest device for storing articles within during transport of the portable play center, the portable play center configured for rolling transport by tilting the play center on the wheels and pulling the handle by a child.

3. A transportable play center comprising:

a center housing defining a center cavity;

a pair of side housings hingedly attached to opposite sides of the center housing, wherein the pair of side housings each define a side cavity and are rotatable between an open position providing access to the center cavity and each of the side cavities and a closed position preventing access to the center cavity, and wherein the side housings each have a side housing depth and a side housing width and the center housing has a center housing depth and center housing width and wherein the side housing depth is about two-thirds the center housing depth and the combined side housing width is about the same as the center housing width;

a pair of wheels attached to the center housing;

a handle for use in transporting the play center, said handle attached to the center housing;

a tabletop slidably received in the center housing;

at least one shelf having transparent sliding doors located in the center housing above the tabletop; and at least one drawer unit removably received in the center housing below the tabletop, the transportable play center configurable for rolling transport by tilting the play center on the wheels and pulling the handle by a child.

4. The transportable storage center of claim 3 wherein the tabletop further comprises at least one leg adapted to be folded under the tabletop when the tabletop is stored in the center housing.

5. The transportable storage center of claim 3 further comprising at least one pouch releasable attached to one of the side housings.

6. The transportable storage center of claim 3 further comprising at least one shelf in one of the side housings and having a transparent sliding door providing access to the shelf.

7. The transportable storage center of claim 3 wherein the storage center is constructed of plastic.

8. The transportable storage center of claim 3 wherein the storage center further comprises a net pouch removably attached to the inside of one of the side housings.

* * * * *